US010829968B2

(12) United States Patent
Topfer et al.

(10) Patent No.: US 10,829,968 B2
(45) Date of Patent: Nov. 10, 2020

(54) MOTOR VEHICLE LOCK COMPRISING INTEGRATED SERVO CLOSING FUNCTION

(71) Applicant: Kiekert Aktiengesellschaft, Heiligenhaus (DE)

(72) Inventors: Claus Topfer, Sindelfingen (DE); Christian Sentzke, Essen (DE); Winfried Schlabs, Bochum (DE); Tim Sonnenschein, Velbert (DE)

(73) Assignee: Kiekert AG, Heiligenhaus (DE)

( * ) Notice: Subject to any disclaimer, the term of this patent is extended or adjusted under 35 U.S.C. 154(b) by 504 days.

(21) Appl. No.: 15/117,302

(22) PCT Filed: Feb. 5, 2015

(86) PCT No.: PCT/DE2015/000043
§ 371 (c)(1),
(2) Date: Oct. 26, 2016

(87) PCT Pub. No.: WO2015/117589
PCT Pub. Date: Aug. 13, 2015

(65) Prior Publication Data

US 2017/0037664 A1 Feb. 9, 2017

(30) Foreign Application Priority Data

Feb. 7, 2014 (DE) ..... 10 2014 001 885

(51) Int. Cl.
*E05B 81/20* (2014.01)
*E05B 79/20* (2014.01)
(Continued)

(52) U.S. Cl.
CPC ..... *E05B 81/20* (2013.01); *E05B 77/34* (2013.01); *E05B 79/20* (2013.01); *E05B 81/64* (2013.01);
(Continued)

(58) Field of Classification Search
CPC ..... E05B 81/20; E05B 77/34; E05B 79/20; E05B 81/64; E05B 81/66; E05B 81/72;
(Continued)

(56) References Cited

U.S. PATENT DOCUMENTS 4,917,418 A * 4/1990 Gokee ..... B60K 15/05 292/125
4,921,288 A * 5/1990 Cifuentes ..... E05B 81/25 292/114
(Continued)

FOREIGN PATENT DOCUMENTS

DE 199 42 360 A1 4/2001
DE 10 2009 036 834 A1 2/2011
(Continued)

OTHER PUBLICATIONS

International Search Report and Written Opinion for corresponding Patent Application No. PCT/DE2015/000043 dated Jun. 11, 2015.

*Primary Examiner* — Carlos Lugo
*Assistant Examiner* — Faria F Ahmad
(74) *Attorney, Agent, or Firm* — Renner, Otto, Boisselle & Sklar, LLP

(57) ABSTRACT

The invention relates to a motor-vehicle lock, in particular a motor-vehicle door lock. In order to provide a reliable assembly and a reliable operation for said lock, the drive housing 6 of the servo closing function 2 is designed to function simultaneously as a Bowden cable bearing 8 and as a receiving chamber or shaft 14 for the micro-switch 15. The drive housing 6 has a robust, compact design and allows the micro-switch 15 to be sited securely in the drive housing 6 always in the same place. This also remains the case as the securing cover 10 is fixed in the drive housing 6 by means of a clip 11.

10 Claims, 3 Drawing Sheets

Figure 1:
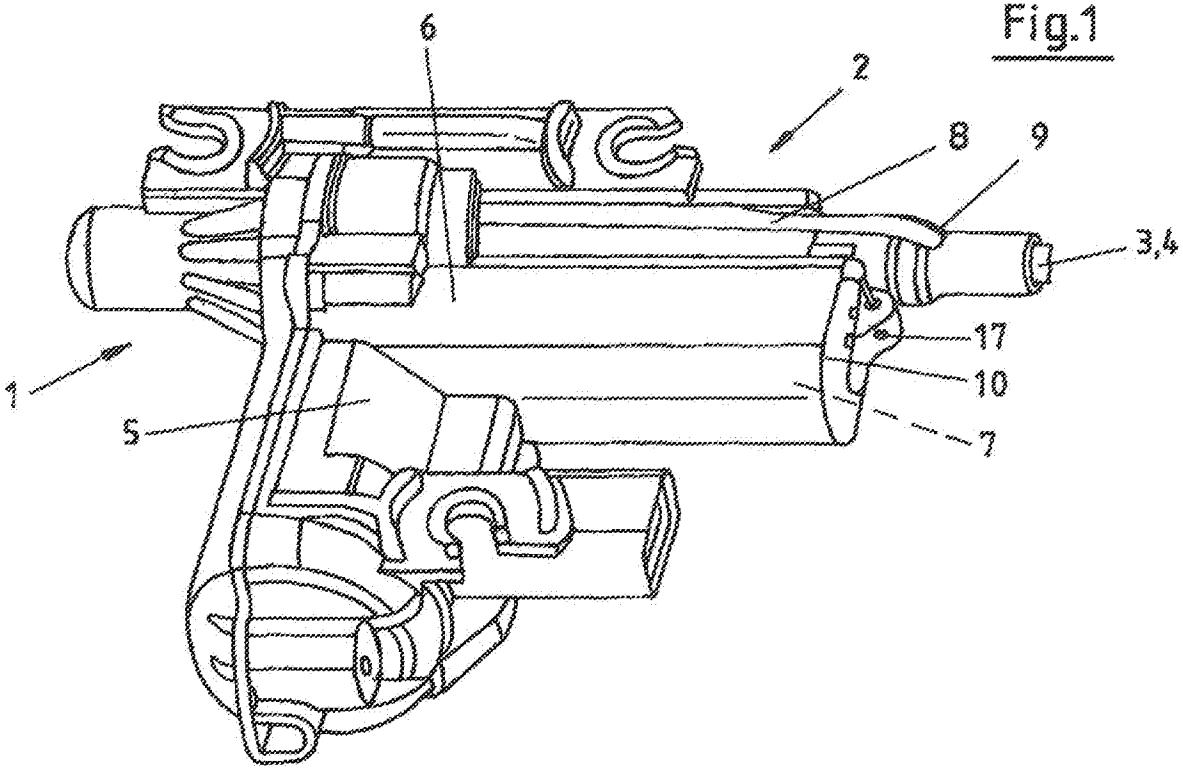

(51) Int. Cl.
*E05B 77/34* (2014.01)
*E05B 81/64* (2014.01)
*E05B 81/66* (2014.01)
*E05B 81/72* (2014.01)

(52) U.S. Cl.
CPC ..... *E05B 81/66* (2013.01); *E05B 81/72* (2013.01); *Y10S 292/23* (2013.01); *Y10S 292/37* (2013.01); *Y10S 292/38* (2013.01); *Y10S 292/60* (2013.01); *Y10S 292/63* (2013.01); *Y10T 292/08* (2015.04); *Y10T 292/0894* (2015.04); *Y10T 292/1047* (2015.04); *Y10T 292/1082* (2015.04); *Y10T 292/1092* (2015.04); *Y10T 292/23* (2015.04)

(58) Field of Classification Search
CPC ..... Y10T 292/0894; Y10T 292/1082; Y10T 292/1092; Y10T 292/1047; Y10T 292/08; Y10S 292/38; Y10S 292/37; Y10S 292/60; Y10S 292/63; Y10S 292/23
USPC ..... 292/201, 210, 216, DIG. 23, DIG. 38, 292/DIG. 37, DIG. 63
See application file for complete search history.

(56) References Cited

U.S. PATENT DOCUMENTS 5,348,356 A * 9/1994 Moulton ..... E05B 37/20 292/80
5,876,087 A * 3/1999 Kleefeldt ..... E05B 81/22 296/155
5,992,194 A * 11/1999 Baukholt ..... E05B 47/0009 292/201
6,056,334 A * 5/2000 Petzold ..... E05B 81/14 292/201
6,062,612 A * 5/2000 Lin ..... E05B 47/0012 292/142
6,102,453 A * 8/2000 Cetnar ..... E05B 77/28 292/199
6,112,564 A * 9/2000 Rathmann ..... E05B 81/66 292/201
6,116,664 A * 9/2000 Wegner ..... E05B 81/66 292/201
6,304,003 B1 * 10/2001 Rathmann ..... E05B 81/06 180/287
6,377,005 B1 * 4/2002 Zintler ..... E05B 81/25 318/653
7,208,686 B1 * 4/2007 Chen ..... G06F 1/181 174/559
8,020,902 B1 * 9/2011 Li ..... E05C 19/06 292/303
8,585,163 B2 * 11/2013 Park ..... F25D 23/025 292/194
8,622,442 B2 * 1/2014 Imatomi ..... B60K 15/05 292/143
8,764,073 B2 * 7/2014 Lin ..... E05B 17/002 277/637
8,870,241 B2 * 10/2014 Lee ..... E05B 81/06 292/144
9,656,544 B2 * 5/2017 Frommann ..... B60K 15/05
2002/0000726 A1 * 1/2002 Zintler ..... E05B 81/90 292/216
2002/0084656 A1 * 7/2002 Lin ..... E05B 47/0012 292/160
2003/0070457 A1 * 4/2003 Arlt ..... E05B 81/14 70/256
2006/0055178 A1 * 3/2006 Graute ..... E05B 85/26 292/216
2007/0046035 A1 * 3/2007 Tolley ..... E05B 81/06 292/201
2012/0313382 A1 * 12/2012 Lee ..... E05B 81/06 292/144
2013/0102163 A1 * 4/2013 Basavarajappa ..... B60K 15/05 439/34
2014/0291996 A1 * 10/2014 Basavarajappa ..... E05C 19/022 292/61
2015/0008685 A1 * 1/2015 Beck ..... B60K 15/05 292/336.3
2015/0115618 A1 * 4/2015 Ito ..... E05B 83/34 292/137
2015/0115619 A1 * 4/2015 Ito ..... E05B 83/34 292/137
2015/0115620 A1 * 4/2015 Ito ..... E05B 83/34 292/137
2015/0115621 A1 * 4/2015 Kitamura ..... E05B 83/34 292/137

FOREIGN PATENT DOCUMENTS

DE 10 2011 075 611 A1 11/2012
DE 20 2012 004789 U1 8/2013
EP 0 744 518 A1 11/1996
EP 1 081 321 A2 3/2001
EP 1 284 333 A2 2/2003

* cited by examiner

MOTOR VEHICLE LOCK COMPRISING INTEGRATED SERVO CLOSING FUNCTION

The invention relates to a motor vehicle door latch, in particular a motor vehicle door latch with a catch, pawl and a closure aid acting on the catch in the form of a drive with an actuator, drive shaft, Bowden cable and a sensor assigned and connected to the drive housing, whereby the catch can be moved out of the pre-ratchet in a motorized manner via the drive into the main ratchet until the sensor responds.

Motor vehicle door latches with such a closure aid are also described as servo latches. With such motor vehicle door latches which are customarily equipped with a locking mechanism comprising a catch and a pawl for latching of the catch, when closing the relevant motor vehicle door or motor vehicle flap the catch is carried over into the main ratchet position using motorized force, after engagement of the pawl into the pre-ratchet position. Usually these are electromotors. Such a motor vehicle door latch is known from DE 199 42 360 A1. Generally, relevant motor vehicle door latches are acted on by an electric motor drive placed alongside the actual motor vehicle door latch via a closure aid interacting with the catch. Such an electric motor drive is the object of DE 10 2009 036 834 A1. This drive has an actuator and a drive shaft and a sensor. During return of the drive shaft, such a sensor ensures that the system cannot reach a hard stop after the catch has moved into the main ratchet. What is more, a second sensor prior to that ensures that the drive motor receives the command to start after engagement of the pawl into the pre-ratchet position. It is known from DE 10 2011 075 611 A1 to arrange the sensor required due to the movement of the catch into the main ratchet alongside the drive housing and to protect it externally via an adhered flap. During the return of the drive, great forces can act on the sensor. Consequently, the flap can open and the securing and precise arrangement of the sensor is not always guaranteed on the drive.

The invention is therefore based on the task of creating a motor vehicle door latch with a sensor for the mechanically moved Bowden cable which safely absorbs the forces occurring during return of the catch and ensures a secure fit of the sensor.

According to the invention, the task is solved in that the sensor is integrated into the drive housing with which the Bowden cable thrust bearing is also connected and a lid securing the sensor is clipped in the drive housing.

With a motor vehicle door latch, in particular a motor vehicle door latch, thus equipped, the Bowden cable thrust bearing is advantageously executed with the housing, whereby a very stable and compact storage is attained, i.e. the Bowden cable thrust bearing and the relevant part of the drive housing or the entire drive housing safely take on the forces arising during movement of the Bowden cable as a component. However, in particular this compact and thus secure drive housing is used to accommodate the sensor to be protected, whereby the part of the drive housing accommodating the sensor is then sealed by means of a lid simultaneously securing the sensor in which the lid is clipped in the drive housing. After applying the lid, the interior in which the sensor is accommodated is sealed externally and this seal cannot be independently loosened from its fit and thus release the sensor to be protected even with forces of any kind arising. The clipping process is also advantageous because this immobilization of the lid is possible without further additional equipment, whereby the lid practically pushes itself into its end position by the clips.

The stable and compact accommodation of the sensor in the drive housing is predominantly possible because the drive housing and the Bowden cable thrust bearing or its covering cap are formed as a single component. As plastic components are involved, these are manufactured in one work operation and thus form a unit which is optimally suited to accommodate the sensor to be protected.

Good and secure accommodation of the sensor is possible in particular according to the invention by the sensor being arranged in a shaft running parallel to the drive in the compact drive housing. It is thus ensured that this sensor can be safely responded to by the moving parts of the drive and is always located in the same position so that faulty switching cannot occur.

Secure positioning within the shaft and easement of installation as a whole is attained when the sensor is pre-installed on the lid and is configured be pushable into the drive housing or its shaft. With the pushing in of the sensor, the lid is therefore simultaneously placed into the installation position and then fixed by clipping in such a way that the sensor is also fixed in the correct position simultaneously.

In principle, it is known to use microswitches as sensors. However, in the present case this is especially advantageous because such a microswitch is particularly suited here to being placed into the respectively correct position pre-installed on the lid into the shaft. It can optimally fulfil its function there without requiring readjustment. Furthermore, movements of other parts of the motor vehicle latch or the drive do not have a negative impact because it is placed very precisely and securely into its operating position pre-installed on the lid.

With clipping the lid in the drive housing, dismantling is possible if an intervention is envisaged into the drive housing or the shaft in order to loosen the clips. According to a further design, however, it is also possible to clip the lid to the drive housing. Consequently, this fixing can also be loosened again from outside of the drive housing or its shaft.

The sensor or the microswitch is usually arranged protected from moisture in the drive housing, whereby this can be ensured in that the lid is connected via a seal with the shaft or the external edge of the shaft. With the placement of the lid on the shaft or the edge of the relevant drive housing, with the clipping the seal also becomes effective, whereby this is in particular possible if the seal is elastic.

A safe end-of-line test which is easy to accomplish is possible if the lid demonstrates an eyelet on the outside as provided for according to the invention. This eyelet enables the tester to verify the precise and tight fit of the lid or in an emergency to perform this test by catching in the eyelet with an auxiliary device.

Above the Bowden cable has been mentioned which can be acted on safely and accurately by the drive because the drive housing simultaneously constitutes the Bowden cable thrust bearing. This Bowden cable is connected to the latch or the drive housing by an end piece corresponding with the relevant construction area or component of the drive housing being installed on the end side on the rope of the Bowden cable. As the Bowden cable thrust bearing and the drive housing form a constructional unit, this end area or the connecting piece of the Bowden cable must be installed into the drive housing from below, which is possible as the rope of the Bowden cable can be fixed via a steel sleeve or a cap-shaped component on the connecting piece or on the Bowden cable thrust bearing pressed on the end side. Although such pressing pieces are known in principle, in the present case it offers the great advantage of securely connecting the end of the Bowden cable to the connecting piece or the Bowden cable thrust bearing.

The invention is distinguished in particular by a motor vehicle latch, in particular a motor vehicle door latch being provided which simultaneously provides a compact drive housing acting as a Bowden cable thrust bearing in which the sensor or microswitch also important for operation is accommodated in such a way that it is securely fixed in the envisaged position and safeguarded from damage. Furthermore, installation is also eased because the sensor or microswitch is pushed into this shaft together with the lid sealing the shaft for the sensor, whereby the lid as such is securely connected with the shaft or the drive housing by clipping.

Figure 2:
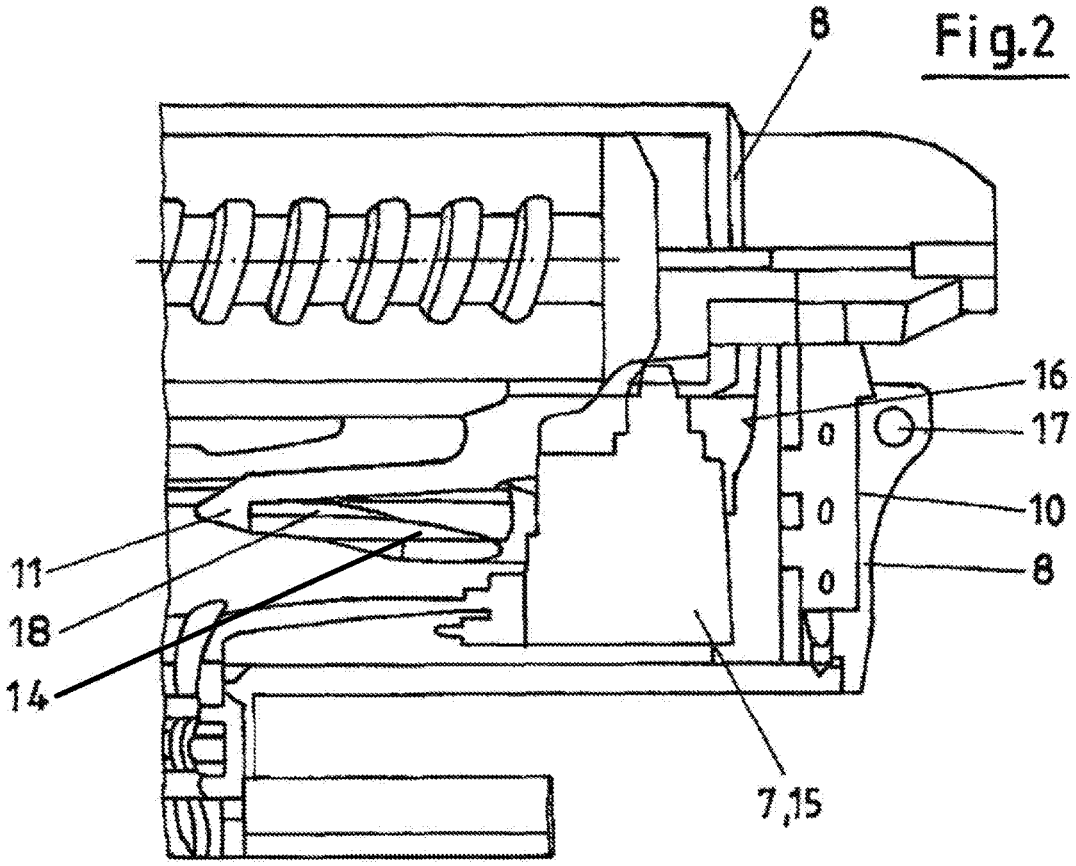
Figure 3:
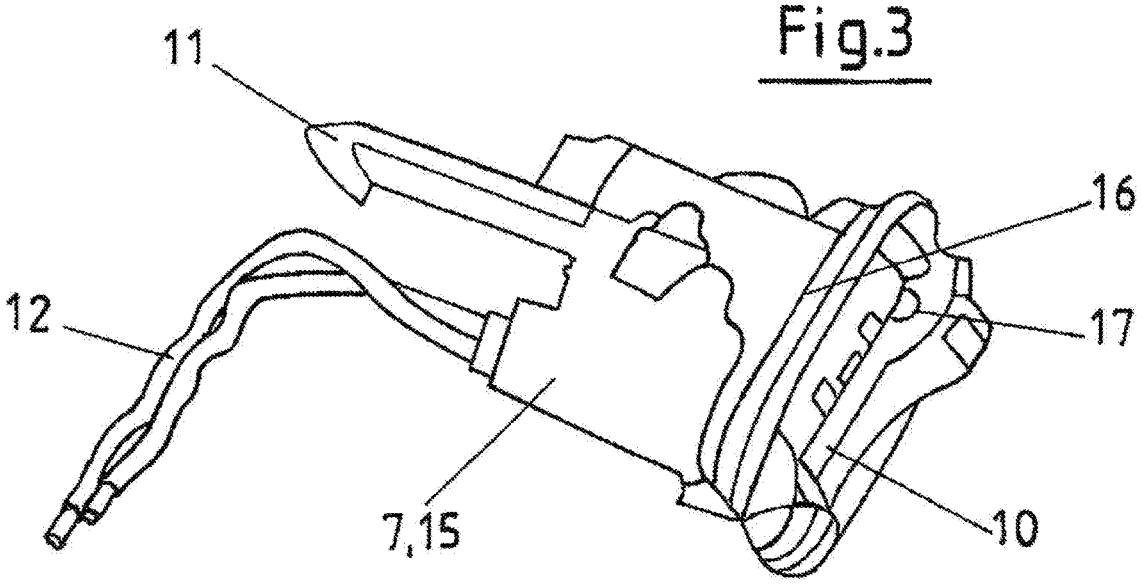
Figure 4:
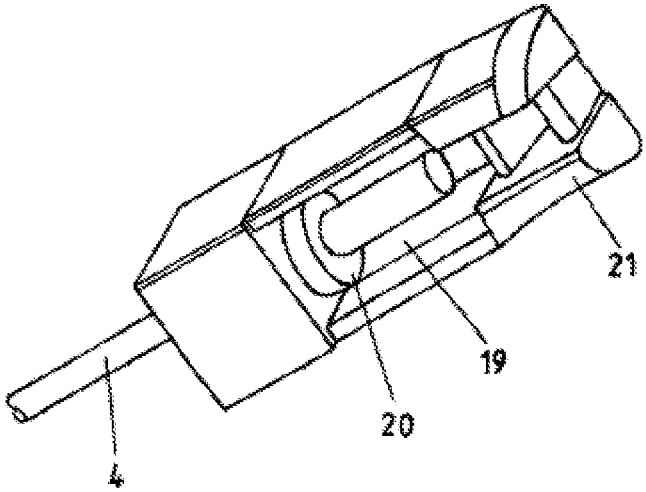

Further details and advantages of the invention object result from the following description of the pertaining sketch in which a preferred execution example is depicted with the necessary details and individual components. The following are shown:

FIG. 1 a lateral view of the drive housing with an integrated sensor,

FIG. 2 a partial section of the drive housing with installed sensor,

FIG. 3 the lid with sensor and the clips interlocking in the drive housing and FIG. 4 the end piece of the Bowden cable or the rope with a steel sleeve applied, A closure aid 2 consisting of a Bowden cable 3 with a rope 4 and a drive 5 is part of a motor vehicle door latch 1 that is not illustrated in detail here. The drive 5 is housed in a quite stable drive housing 6, which simultaneously also forms the Bowden cable thrust bearing 8. The covering cap 9 of the Bowden cable thrust bearing 8 has outlets for the rope 4 on the end side. Beneath this Bowden cable thrust bearing 8 a component is arranged with a shaft 14 in which the sensor 7 outlined in greater detail further along is housed. When the drive shaft not illustrated here returns, i.e. when the movement of the catch which is also not illustrated into the main ratchet is complete, a switch-off command is made to the motor of the drive 5 via the sensor 7 in order to securely prevent the system from 'reaching a hard stop' as previously mentioned. On the outlet side of this shaft 14 a lid 10 is arranged which is connected to the drive housing 6 or the Bowden cable thrust bearing 8 or the shaft 14 in a manner described further along. In order to be able to verify the secure fit of this lid 10 in a simple, it demonstrates an eyelet 17 on the outside.

FIG. 2 shows an open drive housing 6 or Bowden cable thrust bearing 8 with the subsequent shaft 14 and the clipped lid 10, on which the sensor 7, here in the form of a microswitch 15, is fixed. An effective sealing of the shaft 14 is ensured via a merely illustrated seal 16, whereby tensioning of the elastic seal 16 occurs when the lid 10 with its clip 11 is inserted into the drive housing 6 or into the shaft 14. The clip 11 then interlocks behind a part of the shaft 14, whereby it can only be loosened from this position again by an opening area of the drive housing 6 which is not shown here. The external area of the lid 10 with the eyelet 17 necessary for the end-of-line test is also very clearly recognizable here.

The microswitch 15 pre-installed with the lid 10 during installation possesses a supply cable 12 via which the relevant information can also be forwarded to the drive 5 not shown here. From FIG. 3, it is further apparent how the clip 11 is formed and how it can demonstrate the necessary resilience to interlock behind the relevant component 18 and thus to become tense so that the secure position of the microswitch 15 and at the same time the sealing position of the lid 10 is guaranteed.

Finally, FIG. 4 shows the end area of the rope 4 which can be fixed in the drive housing 6 or in the connecting piece 21 as there is a steel sleeve 19 or also a cap-shaped component 20 on the end side, which is pinched with the rope 4 in such a way that the necessary forces can thus be exerted on the rope 4 of the Bowden cable 3.

All stated characteristics, including those taken from the sketches alone, are viewed as crucial to the invention alone and jointly.

The invention claimed is:

1. A motor vehicle door latch comprising:

a motor vehicle door latch with a catch, pawl and a closure aid acting on the catch in the form of a drive with an actuator, drive shaft, Bowden cable and a sensor assigned and connected to a drive housing, whereby the catch can be moved out of a pre-ratchet position in a motorized manner via the drive into a main ratchet position until the sensor responds, wherein the sensor is integrated into the drive housing with which a Bowden cable thrust bearing is also connected, and a lid with a clip interlocking with a component in the drive housing and against the shaft, thereby securing the sensor in the drive housing.

2. The motor vehicle latch according to claim 1, characterized in that, wherein the drive housing and the Bowden cable thrust bearing or its covering cap are formed as a single component.

3. The motor vehicle latch according to claim 1, characterized in that, wherein the sensor is arranged in a shaft running parallel to the drive in the compact drive housing.

4. The motor vehicle latch according to claim 1, wherein the sensor is pre-installed on the lid and is configured to be pushable into its drive housing or its shaft.

5. The motor vehicle latch according to claim 1, wherein the sensor is formed as a microswitch.

6. The motor vehicle latch according to claim 1, wherein the lid is clipped on the drive housing.

7. The motor vehicle latch according to claim 1, wherein the lid is connected to the shaft via a seal.

8. The motor vehicle latch according to claim 7, wherein the seal is elastic.

9. The motor vehicle latch according to claim 1, wherein the lid demonstrates an eyelet on the outside.

10. The motor vehicle latch according to claim 1, wherein the rope of the Bowden cable can be fixed to the connecting piece or the Bowden cable thrust bearing via a steel sleeve pressed on the end side or via a cap-shaped component.

* * * * *